United States Patent [19]

Spencer et al.

[11] Patent Number: 4,772,008

[45] Date of Patent: Sep. 20, 1988

[54] APPARATUS AND METHOD FOR DOUBLE SHEET SEPARATION BY VACUUM PORTS

[75] Inventors: Paul R. Spencer, Meridian, Id.; Anthony C. Palumbo, Jr., Rochester, N.Y.

[73] Assignee: Xerox Corporation, Stamford, Conn.

[21] Appl. No.: 567,607

[22] Filed: Jan. 3, 1984

[51] Int. Cl.[4] ..... B65H 29/70

[52] U.S. Cl. ..... 271/284; 271/188

[58] Field of Search ..... 271/284, 282, 283, 11, 271/20, 103, 106, 260, 188, 209, 276, 194, 195, 196, 197

[56] References Cited

U.S. PATENT DOCUMENTS

| | | | |
|---|---|---|---|
| 3,040,866 | 6/1962 | Rehm | 198/30 |
| 3,224,355 | 12/1965 | Thomiszer | 271/284 X |
| 3,504,911 | 4/1970 | Silverberg | 271/56 |
| 3,674,257 | 7/1972 | Neeb et al. | 271/64 |

OTHER PUBLICATIONS

IBM Technical Disclosure, vol. 6, No. 8, Jan., 1964, pp. 17–18.

*Primary Examiner*—Joseph J. Rolla

*Attorney, Agent, or Firm*—William A. Henry, II

[57] ABSTRACT

An apparatus and method for separating doublets includes a device in which opposed surfaces that are connected to a vacuum source have a rippled portion in which vacuum slots are positioned at the apex of the ripples. There is a gradual transition in the surface of the slots from a planar portion to a rippled portion and back to a planar portion. The two surfaces are spaced a predetermined distance from each other such that when a double sheet of paper is driven through the rippled area, both the upper sheet and the lower sheet can tack to the upper and lower slots without having to jump across a gap. Subsequently, as the two sheets move into the area of the surfaces where there are no ripples, a strong separating force is generated as each sheet remains attached to the respective vacuum slots since the upper and lower slots are not in the same plane.

7 Claims, 2 Drawing Sheets

APPARATUS AND METHOD FOR DOUBLE SHEET SEPARATION BY VACUUM PORTS

BACKGROUND OF THE INVENTION

This invention relates generally to sheet separators and more particularly to a sheet separator and method for separating doublets as they are advanced through an area of a machine, e.g., a copying machine.

Separation of double sheets of paper is useful for jam prevention or shutdown of machines which handle individual paper sheets, such as copying machines. In the sheet handling operation of copying machines, it is extremely important that not more than a single copy sheet be fed to the photoconductor at a time because to do so could cause damage to the photoconductor as well as waste of paper and operator time in having to go into the machine and remove jammed sheets due to their superposed relationship.

A number of attempts have been made to provide double sheet separation along a paper transport route without having obtained complete success. For example, one prior method is shown in U.S. Pat. No. 3,504,911 where first and second opposed plate members form a passageway through which sheets are advanced along a path of travel. Port means are laterally positioned in the plate members to distribute applied vacuum within the passageway, the port means being longitudinally positioned proximate to the exit of the plate members to provide an area of high pneumatic resistance within the passageway between the entrance thereof and the port means, and an area of low pneumatic resistance within the passageway between the exit thereof and the port means. A vacuum is applied to the passageway through the port means via a manifold connected to a supply source. As a result of this high pneumatic resistance at the entrance end, air enters the passageway through the exit end in response to the vacuum pressure to separate superposed sheets located therein.

In another attempt at superposed sheet separation, U.S. Pat. No. 3,040,866 discloses a vacuum separation device used in a conveying system. Two belts having vacuum ports are initially opposed close together in a parallel arrangement and are then guided farther apart thereby creating a separating force for doublets as the opposed members of the doublets are attached by vacuum force to the opposed belts which become increasingly further apart. Yet another doublet separating device is shown in U.S. Pat. No. 3,674,257 where two opposed plates have rows of vacuum apertures. The bottom plate has a plurality of guides in line with the apertures which intercept the path of travel along a portion of the plate face area so that the advancing sheets are raised from the lower face toward the upper face thereby putting the upper sheet of the doublet into position to be picked up by the vacuum apertures of the upper face while the lower sheet of the doublet remains attached to the lower vacuum apertures, thus bringing about separation of doublets. IBM Technical Disclosure Bulletin, Vol. 6, No. 8, January 1964, pages 17, 18 shows a double sheet detector that employs vacuum means to separate sheets.

A major disadvantage of the previously described doublet separators has been their ineffectiveness in handling a wide variety of sheet porosities, sheet overlapping relationships and the tendancy of sheets to feed in slugs.

SUMMARY OF THE INVENTION

Accordingly, a doublet separator is provided that minimizes the above-mentioned problems and comprises vacuum slots in opposed surfaces through which doublets must pass. The opposed surfaces are connected to a vacuum source and have a portion of their surfaces rippled. The slots are located in the apex of the ripples and extend throughout the rippled portion and over a major portion of the opposed surfaces, such that doublets passing through the opposed surfaces will be subjected to strong separation forces in order to assure doublet separation.

BRIEF DESCRIPTION OF THE DRAWINGS

The foregoing and other features of the instant invention will be apparent from a further reading of the specification and claims and from the drawings in which:

FIG. 4 illustrates the doublet separator of the present invention in a sensing apparatus as adapted for use in an automatic sheet advancing device of a copier or the like.

DESCRIPTION OF THE PREFERRED EMBODIMENTS

Figure 1:
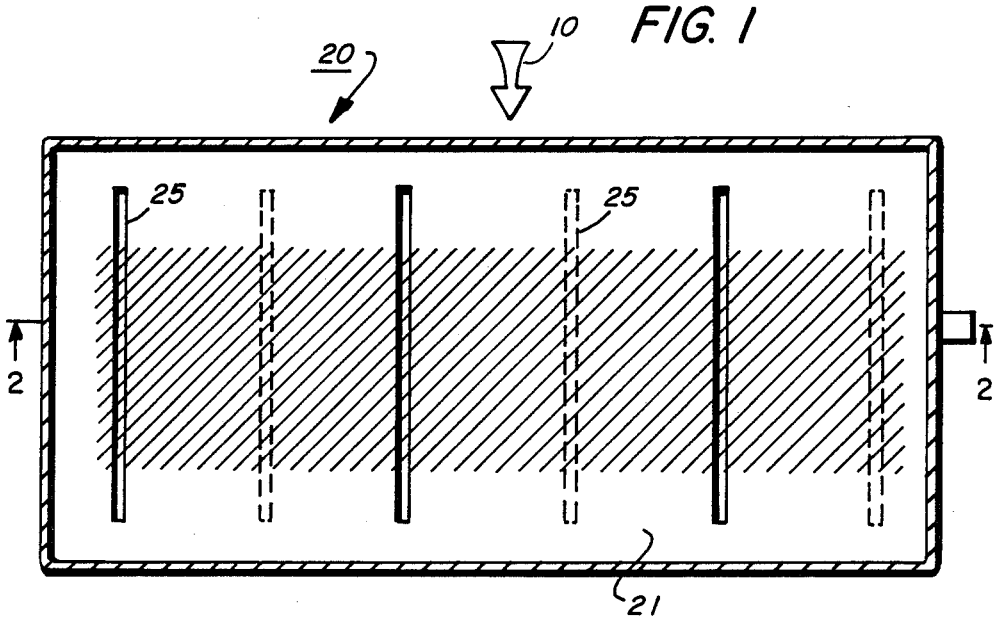
FIG. 1 is a plan view of the doublet separator according to the present invention with the top of one manifold removed.
Figure 2:
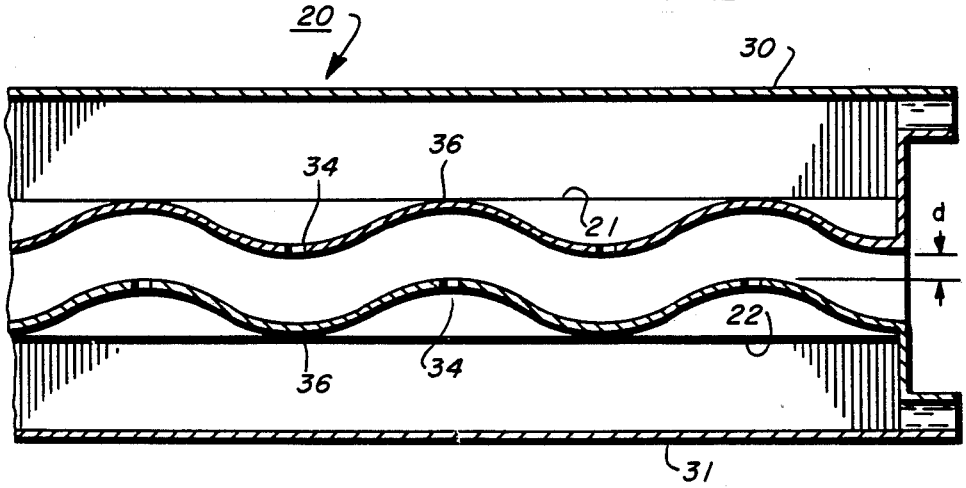
FIG. 2 is an enlarged cross sectional view of FIG. 1 taken along line 2—2.

With reference to FIGS. 1 and 2, there is illustrated a sheet separator device in which opposed surfaces have a rippled portion in which vacuum ports or slots are positioned at the apex of the ripples with the two opposed rippled portions being spaced a predetermined distance d apart and generally designated 20 as contemplated by the present invention. The predetermined distance d will change depending upon the thickness and porosity of the range of sheets to be accommodated. The separating device or head 20 includes a pair of plate members or opposed surfaces 21 and 22 which are positioned adjacent the path of travel generally parallel thereto in an opposed spaced relationship. Plate members 21 and 22 preferably extend transversely across the path of travel and longitudinal thereto to provide a passageway through which sheets are advanced for further processing. A plurality of apertures or port members 25 are positioned across plate members 21 and 22 parallel to the path of travel the direction of arrow 10 as shown in FIG. 1 and as may be seen in connection with FIG. 2. A pair of enclosures or manifolds 30 and 31 are connected to plate members 21 and 22 respectively and serve to define vacuum chambers extending vertically from the plate members and surrounding port members 25. Guide members could be added to the enclosures in order to guide sheets through the passageway if desired.

The vacuum ports in the two surfaces 21 and 22 are separated by a predetermined distance d shown in FIG. 2. Over a major portion of the ports or slots (the shaded area), the port surfaces are rippled as shown in FIG. 2. The ridges 34 and valleys 36 of the ripples are parallel to the slots. There is a gradual transition from the horizontal plane port surfaces 21 and 22 to the rippled surfaces and back gain. As shown in FIG. 2, there are vacuum slots on the convex or apex portion of the ripples. The amplitude of the ripples is arranged so that the vacuum slots of the upper and lower surfaces are essentially in a plane. Thus, when a double sheet of paper is driven through the rippled area, both the upper sheet and the lower sheet can tack to the upper and lower slots respectively without having to jump across the gap. Then as the two sheets move into the slot area where there are no ripples, a strong separating force is generated as each sheet remains attached to the nearby vacuum slots, because the slots on the upper and lower ports are not in the same plane.

Figure 3:
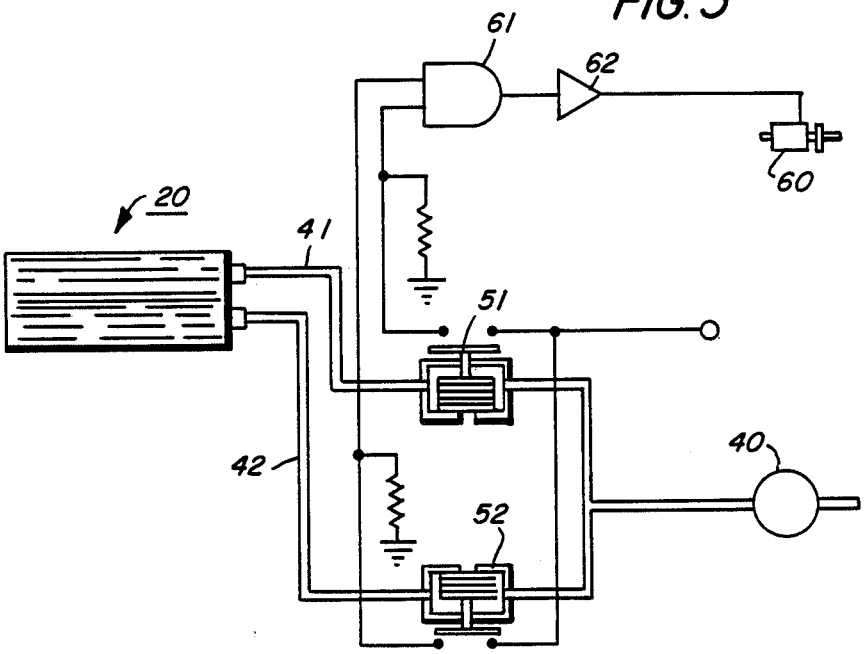
FIG. 3 schematically illustrates a multiple sheet detection system incorporating the present invention.

As shown in FIG. 3, vacuum is supplied to the respective chambers 30 and 31 of sheet separator 20 by means of an air pump 40. Air pump 40 may be driven by a suitable source such as a conventional motor. Vacuum pressure from air pump 40 is conducted to port members 25 in plates 21 and 22 via conduits 41 and 42 connected to the respective surrounding chambers.

A pair of pressure responsive switches or pneumatically operated relays 51 and 52 of a type which are generally well known are connected to vacuum conduits 41 and 42 to be actuated in response to a change in pressure. In this way, the passge of a doublet through separator 20 is indicated. The pressure in separator device 20 as a result of the presence of multiple sheets in the passgeways, condition an electrical circuit to control advancement of sheets along the path of travel.

An electromagnetically actuated clutch or brake assembly 60 such as schematically illustrated in connection with FIG. 3 may be utilized to control the advancement of sheets along the path of travel. As schematically illustrated in FIG. 3, clutch assembly 60 is operated to interrupt advancement of sheets in response to a high level signal from the output terminal of AND gate 61 via amplifier 62. With the relays 51 and 52 open as shown in FIG. 3, a low level signal is supplied to the input terminals of AND gate 61 thus resulting in a low level signal at the output terminal of gate 61. With one of the relays 51 and 52 closed and the other open, a high level signal is provided at the respective input terminal of gate 61 to which the closed relay is connected and a low level signal is provided at the respective input terminal to which the open relay is connected thus resulting in a low level signal at the output terminal of gate 61. With both of the relays 51 and 52 closed, a high level signal is provided at each of the input terminals of gate 61 thus resulting in a high level signal at the output terminal, which high level signal alters the condition of clutch assembly 60. Thus, the operating condition of clutch assembly 60 is changed only in response to a change in condition of both relays 51 and 52.

With the electrical circuitry conditioned as shown in connection with FIG. 3, a sheet may be advanced between the plate members 21 and 22 as seen in FIG. 2. As ambient air is drawn into the respective vacuum chambers surrounding plate members 21 and 22 through the port members 25, the single sheet may be drawn against one of the sets of port members, for example, those in plate member 22. As a sheet is drawn thereagainst, inhibiting but not completely interrupting the air flow through conduit 42, a drop in pressure within the surrounding vacuum chamber and vacuum conduit 42 is experienced. This change in pressure effects actuation of pneumatic relay 52 closing the respective circuit and providing a high level signal at the input terminal of AND gate 61. However, this does not alter the condition of clutch assembly 60 due to the unchanged low level signal which is provided at the output terminal of AND gate 61. With the circuit thus conditioned the single sheet is uninterruptedly advanced by the advancing mechanism through the passageway and into further forwarding means. As the sheet passes from the passageway and engagement with port members 25, a rise of pressure within vacuum conduit 42 is experienced which returns the circuit to the condition as shown in FIG. 3.

With the electrical circuitry again conditioned as shown in connection with FIG. 3, a plurality of superposed sheets may be advanced between the plate members 21 and 22. As ambient air is drawn into the respective vacuum chambers surrounding plate members 21 and 22 through the port members 25, the superposed sheets may be drawn, for example, firstly against one of the sets of port members such as those in plate member 22. As was described in connection with a single sheet, a drop in pressure within the surrounding vacuum chamber and vacuum conduit 42 is experienced. This change in pressure effects actuation of pneumatic relay 52 closing the respective circuit and providing a high level signal at the input terminal of AND gate 61.

With sheets drawn against each opposed surface of members 21 and 22 and the ports in each member, the sheets are advanced in contact therewith toward the exit end of the passageway, i.e., the portions of the opposed surfaces which are not rippled are separated by a greater distance than the rippled portions thus, when two sheets move from the rippled area into an area where there are no ripples, a strong separating force is generated as the two sheets remain attached to the ports which are then no longer close together.

With sheets in engagement with the port members in plate members 21 and 22, both of the relay 51 and 52 are actuated, closing the respective circuits. With both circuits closed, a high level signal is supplied to the input terminals of AND gate 61 providing a high level signal at the output terminal gate 61 which is then utilized to condition clutch member 60 in response thereto.

Figure 4:
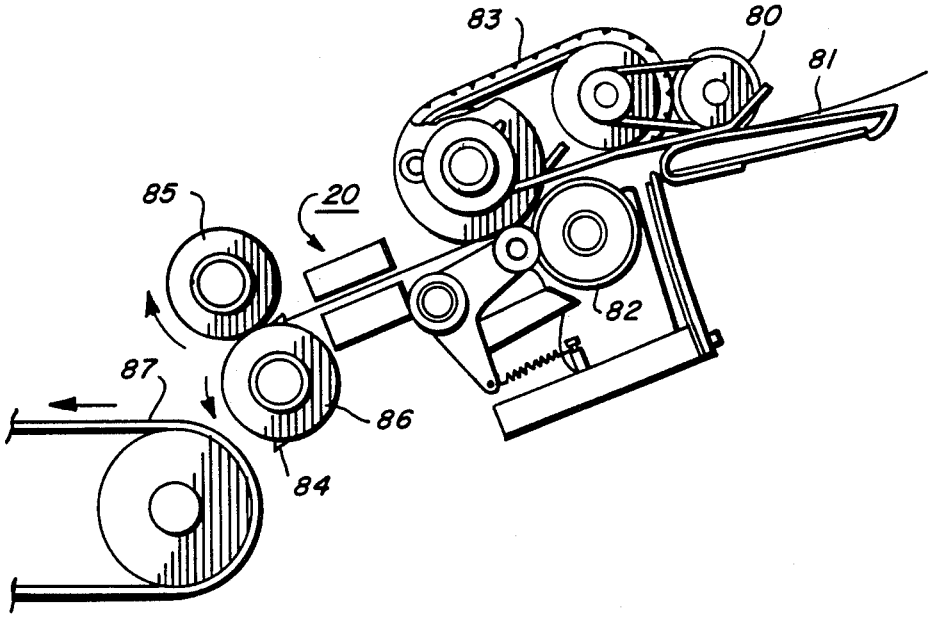

Referring to FIG. 4, the sheet detecting apparatus incorporating the present invention is particularly adapted for use in connection with a sheet feeding apparatus of a copying machine. In such devices, sheets are singularly advanced for imaging in a xerographic machine by means of a friction drive wheel 80 engaging the top portion of an adjustably supported stack of sheets 81. Sheets from the top of the stack are advanced by the friction drive wheel 80 into the wrap formed between a stationary retarding roll or abutment member 82 which is in substantial contact with the moving surface of a belt member 83. Adhering overlapping sheets are separated by the abutment member as they are advanced through the wrap. The uppermost sheet in the wrap is advanced by the belt member 83 through the passageway between plate members 21 and 22 to engage a sheet interrupter 84 before being released to a pair of continuously rotating friction rolls 85, 86 which deliver the sheet to the moving transport 87 of the copying machine.

In the event that more than a single sheet is advanced into the a passageway between plate members 21 and 22, the uppermost sheet therein is drawn against the port members in plate member 21 and the lowermost sheet therein is drawn against the port members in plate member 22 in the manner as previously described. With the upper most and lowermost sheets in engagement with the respective port members in plate members 21 and 22, the electrical circuitry is conditioned to provide a high level signal at the output terminal of AND gate 61 in the manner as previously described. In this embodiment, the output of AND gate 61 is connected to an input terminal of a gate circuit which controls the release of sheet interrupting member 84. This arrangement inhibits the release of sheet interrupting member 84 and hence the release of an engaged sheet to the pinch rolls 85, 86 in the event that more than a single sheet has been advanced through the passageway between plate members 21 and 22.

From the foregoing description, it may be seen that there is provided an improved means for separating and detecting the passage of multiple superposed sheets in a sheet handling operation.

While the invention has been described with reference to the structure disclosed herein, it will be understood that various modifications may be made without departing from the spirit of the invention, and this application is intended to cover such modifications or changes as may come within the purpose of the improvements or the scope of the following claims.

What is claimed is:

1. A superposed sheet separator, comprising:

means defining opposed surfaces through which a sheet doublet passes;

port means located in said opposed surfaces;

means for providing a vacuum to said port means; and rippled means located in a portion of said opposed surfaces, said port means being positioned at the apices of ripples in said rippled means such that as two sheets move from an area of said opposed surfaces where there are ripples to a non-rippled area a strong separating force is generated on each sheet by said port means.

2. The superposed sheet separator of claim 1, wherein said part means in said rippled means of said opposed surfaces are not in the same plane.

3. The superposed sheet separator of claim 1, wherein said rippled means comprises undulating areas on said opposed surfaces having peaks and valleys with said slots being located in said peaks of said opposed surfaces with said peaks of one opposed surface being positioned opposite valleys of the other opposed surface.

4. The superposed sheet separator of claim 1, wherein said opposed surfaces include a smooth portion that gradually merges into said rippled means and back into a smooth portion.

5. A method for separating doublets, comprising the steps of:

a. providing a pair of opposed surfaces;

b. connecting a vacuum source to said opposed surfaces;

c. locating a series of port means within said opposed surfaces with said port means communicating with said vacuum source and extending over a major portion of said opposed surfaces; and d. providing a rippled area over a portion of said opposed surfaces, said rippled area covering a major portion of said port means, whereby as two sheets pass between said opposed surfaces said vacuum source will separate the sheets and draw them against the respective said opposed surfaces.

6. The method of claim 5, including the steps of locating said port means along the apices of ripples in said rippled area.

7. The method of claim 6, including the step of positioning said apices of said ripples of said opposed surfaces in different planes.

* * * * *